US005611359A

United States Patent [19]

Ogura et al.

[11] Patent Number: 5,611,359

[45] Date of Patent: Mar. 18, 1997

[54] PREDRYING APPARATUS FOR A FILTER CIGARETTE MANUFACTURING SYSTEM

[75] Inventors: Shinji Ogura; Tatsuya Hasegawa, both of Tokyo, Japan

[73] Assignee: Japan Tobacco Inc., Tokyo, Japan

[21] Appl. No.: 408,865

[22] Filed: Mar. 23, 1995

[30] Foreign Application Priority Data

Mar. 31, 1994 [JP] Japan ..... 6-063706

[51] Int. Cl.[6] ..... A24C 5/26; A24C 5/47

[52] U.S. Cl. ..... 131/88; 131/68; 131/94

[58] Field of Search ..... 131/68, 88, 94

[56] References Cited

U.S. PATENT DOCUMENTS

| | | | |
|---|---|---|---|
| 3,371,000 | 2/1968 | Davenport et al. | 131/88 X |
| 4,291,713 | 9/1981 | Frank | 131/68 |
| 4,368,743 | 1/1983 | Barbe et al. | 131/88 |

FOREIGN PATENT DOCUMENTS

| | | |
|---|---|---|
| 2378461 | 8/1978 | France . |
| 63-43077 | 8/1988 | Japan . |
| 2073004 | 10/1981 | United Kingdom . |

*Primary Examiner*—Jennifer Bahr

*Attorney, Agent, or Firm*—Birch, Stewart, Kolasch & Birch, LLP

[57] ABSTRACT

A predrying apparatus is incorporated in a filter attachment machine of a filter cigarette manufacturing system, and includes a speed sensor for detecting the traveling speed of tip paper, a movable heater movable toward and away from the tip paper for heating the same, an actuator for moving the movable heater, and a control unit for controlling the operation of the actuator in accordance with the speed sensor output. When it is judged based on the speed sensor output that the tip paper is stopped or traveling at low speed, the movable heater is moved away from the tip paper by the actuator, and when it is judged that the tip paper is traveling at high speed, the movable heater is moved toward the tip paper by the actuator.

29 Claims, 6 Drawing Sheets

PREDRYING APPARATUS FOR A FILTER CIGARETTE MANUFACTURING SYSTEM

BACKGROUND OF THE INVENTION

1. Field of the Invention

The present invention relates to a filter attachment machine for a filter cigarette manufacturing system, and more particularly, to a predrying apparatus incorporated in the filter attachment machine for predrying paste applied to tip paper.

2. Description of the Related Art

In recent years tobacco with mild taste has been in demand. To meet the demand, filter cigarettes each having a filter at one end of a cigarette are on the market. Filters are attached to respective cigarettes in a filter attachment machine of a cigarette manufacturing system, by wrapping a piece of tip paper around a cigarette and a filter. To this end, typically a wrapping section provided in the filter attachment machine is supplied with filter plugs each interposed between two cigarettes, as well as pieces of tip paper applied with paste.

In connection with the supply of pieces of tip paper applied with paste, the filter attachment machine has a transport path for guiding the tip paper unrolled from a paper roll to the wrapping section, and a paste applicator is arranged so as to face the transport path for applying paste to one side of the tip paper. On the downstream side of the paste applicator, a cutter is arranged for cutting the tip paper, which has been applied with paste, into pieces with a predetermined length. Also, a heater is arranged on the upstream side of the paste applicator for heating the one side of the tip paper to be applied with paste prior to the paste applying step, and a predrying apparatus is arranged on the downstream side of the paste applicator for heating the opposite side, or the non-paste side, of the tip paper to dry the paste applied to the tip paper by means of heat conducted to the paste from the tip paper.

Pieces of tip paper are supplied from the cutter to the wrapping section, where each piece of tip paper is wrapped around two cigarettes with a filter plug therebetween. Normally, by this time, the paste applied to the tip paper has been properly predried by the heater and the predrying apparatus, and thus the wrapping of tip paper pieces around cigarettes and filter plugs can usually be performed stably. Double-length filter cigarettes obtained in this manner, each connected by a piece of tip paper, are cut in the center of the filter plug, thereby obtaining individual filter cigarettes which will be finally dried, e.g., by air seasoning. The term "predry" is used herein in contrast with this "final drying."

In order to predry the tip paper as mentioned above, a heater fixedly disposed to face the tip paper transport path is conventionally used. A typical fixed heater includes a heating sheet which is affixed to a surface of a guide plate, defining part of the tip paper transport path, to produce a certain quantity of heat. Accordingly, if thermal parameters (e.g., the traveling speed of the tip paper) that affect the quantity of heat transferred to the tip paper from the fixed heater are constant, a heat quantity most suited for predrying the paste can be given to the paste-applied tip paper traveling along the transport path.

However, the thermal parameters including the tip paper traveling speed (more generally, parameters determining the predried state of paste) do not always remain fixed, but vary with changes in the operating state or operating environment of the cigarette manufacturing system.

Thus, where a constant heat quantity is transferred from the fixed heater to the tip paper, the heat quantity given to the tip paper per unit area varies if the tip paper traveling speed or the like changes, making it difficult to optimize the predried state of paste and possibly causing defective wrapping of the tip paper around cigarettes and filter plugs. Specifically, if the traveling speed of the tip paper decreases below a set speed, the paste is excessively dried, which results in reduced adhesive strength of the paste or warp of tip paper pieces, for example. Conversely, if the traveling speed of the tip paper is too fast, then the paste is insufficiently dried; in this case, paste overflows a piece of tip paper when the tip paper is wound, for example, damaging the external appearance of filter cigarettes.

SUMMARY OF THE INVENTION

An object of the present invention is to provide a predrying apparatus incorporated in a filter attachment machine of a filter cigarette manufacturing system, which apparatus can optimize the predried state of paste applied to tip paper even when various conditions affecting the predried state vary, thus permitting reliable and efficient manufacture of high-quality filter cigarettes.

According to the present invention, there is provided a predrying apparatus for heating tip paper traveling along a tip paper transport path of a filter attachment machine of a filter cigarette manufacturing system to preliminarily dry paste applied to the tip paper. The apparatus comprises detecting means for detecting at least one first parameter value which affects predried state of the paste, heating means for heating a predetermined surface of the tip paper, and heat control means for changing a degree to which the tip paper is heated by the heating means, in accordance with the detected first parameter value.

The advantage of the present invention resides in that the degree or extent to which the tip paper is heated by the heating means can be varied in accordance with changes in various conditions that affect the predried state of the paste, and thus the paste can always be most properly predried. Accordingly, the tip paper can always be appropriately wrapped around cigarettes and filter plugs, permitting efficient and reliable manufacture of high-quality filter cigarettes.

Preferably, the heat control means controls the heating means so as to reduce the degree of heating the tip paper by the heating means when the detected first parameter value indicates that the predrying is excessively carried out, and controls the heating means so as to increase the degree of heating the tip paper by the heating means when the detected first parameter value indicates that the predrying is excessively restricted.

According to this preferred embodiment, the degree of heating the tip paper by the heating means can be appropriately varied in accordance with changes in various conditions affecting the predried state of the paste.

Preferably, the detecting means detects, as the first parameter value, at least one second parameter value which affects the quantity of heat transferred to the predetermined surface of the tip paper from the heating means. The heat control means controls the heating means so as to reduce the degree of heating the tip paper by the heating means when the detected second parameter value indicates that the quantity of heat is excessively large, and controls the heating means so as to increase the degree of heating the tip paper by the heating means when the detected second parameter value indicates that the quantity of heat is excessively small.

According to this preferred embodiment, the degree of heating the tip paper by the heating means can be varied in accordance with changes in various conditions that affect the quantity of heat transferred to the tip paper from the heating means (primary conditions determining the predried state of paste).

Still preferably, the detecting means detects, as the second parameter value, a value of traveling speed of the tip paper. The heat control means controls the heating means so as to reduce the degree of heating the tip paper by the heating means when the detected value of traveling speed of the tip paper indicates that the tip paper is stopped or traveling at low speed, and controls the heating means so as to increase the degree of heating the tip paper by the heating means when the detected value of traveling speed of the tip paper indicates that the tip paper is traveling at high speed.

According to this preferred embodiment, the degree of heating the tip paper by the heating means can be varied in accordance with changes in the tip paper traveling speed (primary condition determining the heat quantity transferred to the tip paper from the heating means).

Preferably, the heating means includes a heater assembly movable toward and away from the predetermined surface of the tip paper for heating the predetermined surface of the tip paper, and the heat control means includes an actuator for moving the heater assembly toward and away from the predetermined surface of the tip paper. The heat control means moves the heater assembly in the direction away from the predetermined surface of the tip paper by means of the actuator when the detected first parameter value indicates that the predrying is excessively carried out, and moves the heater assembly in the direction toward the predetermined surface of the tip paper by means of the actuator when the detected first parameter value indicates that the predrying is excessively restricted.

Still preferably, the detecting means detects, as the first parameter value, at least one second parameter value which affects the quantity of heat transferred to the predetermined surface of the tip paper from the heating means. The heat control means moves the heater assembly in the direction away from the predetermined surface of the tip paper by means of the actuator when the detected second parameter value indicates that the heat quantity is excessively large, and moves the heater assembly in the direction toward the predetermined surface of the tip paper by means of the actuator when the detected second parameter value indicates that the heat quantity is excessively small.

Further preferably, the detecting means detects, as the second parameter value, a value of traveling speed of the tip paper. The heat control means moves the heater assembly in the direction away from the predetermined surface of the tip paper by means of the actuator when the detected value of the tip paper traveling speed indicates that the tip paper is stopped or traveling at low speed, and moves the heater assembly in the direction toward the predetermined surface of the tip paper by means of the actuator when the detected value of the tip paper traveling speed indicates that the tip paper is traveling at high speed.

According to the above three preferred embodiments, the distance between the heater assembly and the tip paper (the degree of heating the tip paper by the heater assembly) can be appropriately varied in accordance with changes in various conditions affecting the predried state of paste (preferably, in accordance with changes in various conditions affecting the heat quantity transferred to the tip paper from the heater assembly, or more preferably, in accordance with changes in the tip paper traveling speed), by using the apparatus with relatively simple structure.

Still preferably, the heater assembly is movable between a first position where the heater assembly is in contact with or close to the predetermined surface of the tip paper, and a second position where the heater assembly is remote from the predetermined surface of the tip paper. The heat control means positions the heater assembly at the second position by means of the actuator when the detected value of the tip paper traveling speed indicates that the tip paper is stopped or traveling at low speed, and positions the heater assembly at the first position by means of the actuator when the detected value of the tip paper traveling speed indicates that the tip paper is traveling at high speed.

According to this preferred embodiment, the degree of heating the tip paper by the heater assembly can be varied in accordance with change in the tip paper traveling speed, by using the apparatus with relatively simple structure.

Preferably, the actuator includes a speed reducing mechanism for reducing the moving speed of the heater assembly as the heater assembly approaches the predetermined surface of the tip paper.

According to this preferred embodiment, when the heater assembly is moved to a position close to or even in contact with the tip paper, interference between the tip paper and the heater assembly is reliably prevented, thus ensuring stable travel of the tip paper.

Preferably, the predrying apparatus further comprises a pair of fixed guides disposed in contact with the predetermined surface of the tip paper, and the heater assembly is arranged along the tip paper transport path between the two fixed guides.

In this preferred embodiment, the travel level of the tip paper can always be maintained at a fixed level, whereby the degree of heating the tip paper by the heating means can be controlled more appropriately.

Preferably, the heating means is arranged on the downstream side of a paste applicator of the filter attachment machine with respect to the tip paper transport path, and heats the predetermined surface of the tip paper opposite to the surface thereof to which paste has been applied by the paste applicator.

According to this preferred embodiment, the predried state of paste can be properly adjusted by heating the surface of the tip paper opposite to the paste-applied surface.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
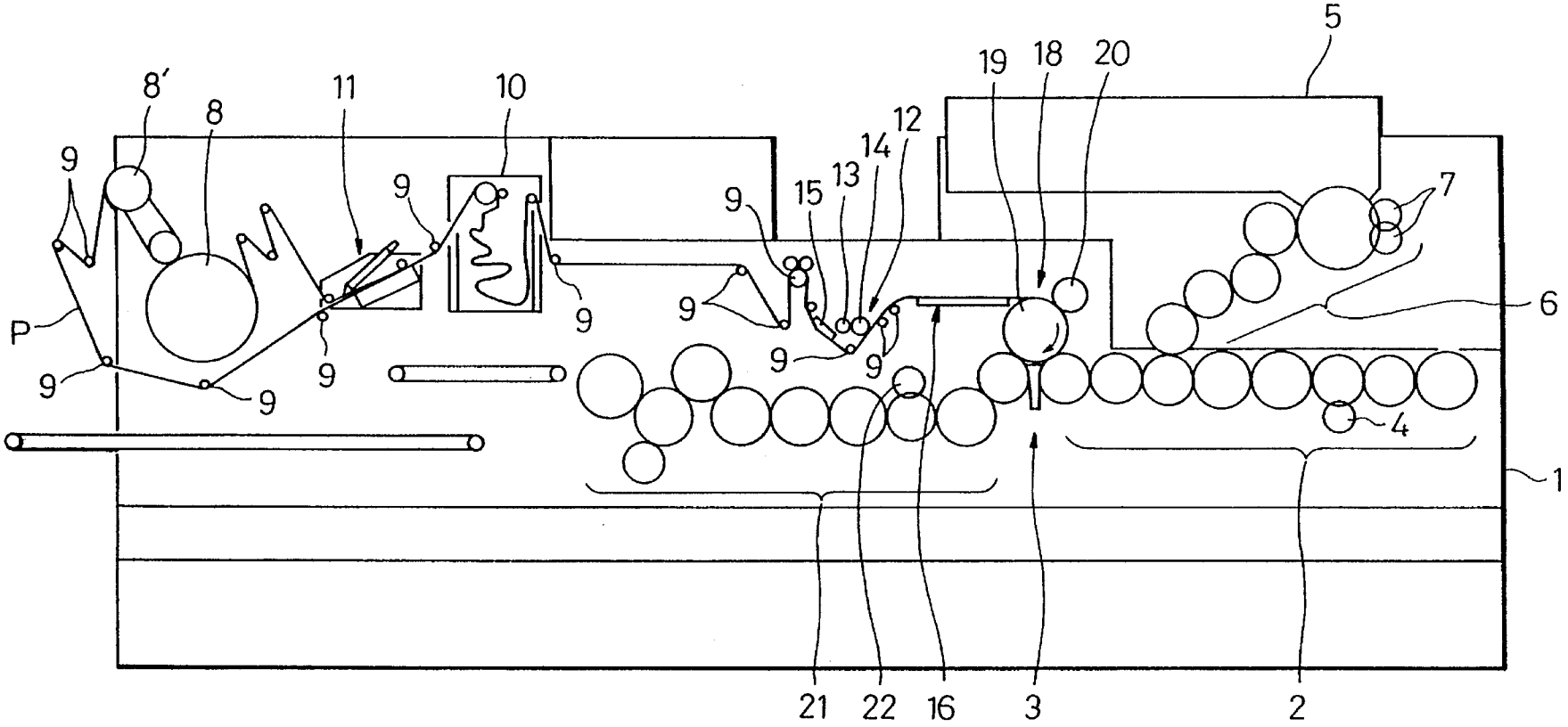
FIG. 1 is a schematic front view of a filter attachment machine of a filter cigarette manufacturing system equipped with a predrying apparatus according to one embodiment of the present invention.

Referring to FIG. 1, a filter attachment machine of a filter cigarette manufacturing system comprises a base frame 1. A drum train 2 composed of a large number of drums is arranged on the right-hand part of the base frame 1 as viewed in FIG. 1. Each of the drums has a number of grooves formed in the outer peripheral surface thereof at an equal distance from each other. A drum located at the upstream end of the drum train 2 adjoins a cigarette forming machine (not shown) of the cigarette manufacturing system, and cigarette rods produced by the cigarette forming machine, each having a length twice that of a cigarette, are fed into the respective grooves of the drum at the upstream end. The grooves of each drum are connected to a negative pressure generator through control valves, though not illustrated, so that negative attracting force is selectively produced in the individual grooves.

As the drums forming the drum train 2 rotate, cigarette rods fed to the drum at the upstream end are transported by a large number of intermediate drums and a drum located at the downstream end, toward a wrapping section 3 of the filter attachment machine. In this case, the negative attracting force is intermittently produced in the grooves of the individual drums at suitable timing. Due to the intermittent application of the attracting force and the rotation of the drums, cigarette rods are transferred from one drum to another adjacent thereto, that is, from the grooves of an upstream drum to those of a downstream drum.

Figure 2:
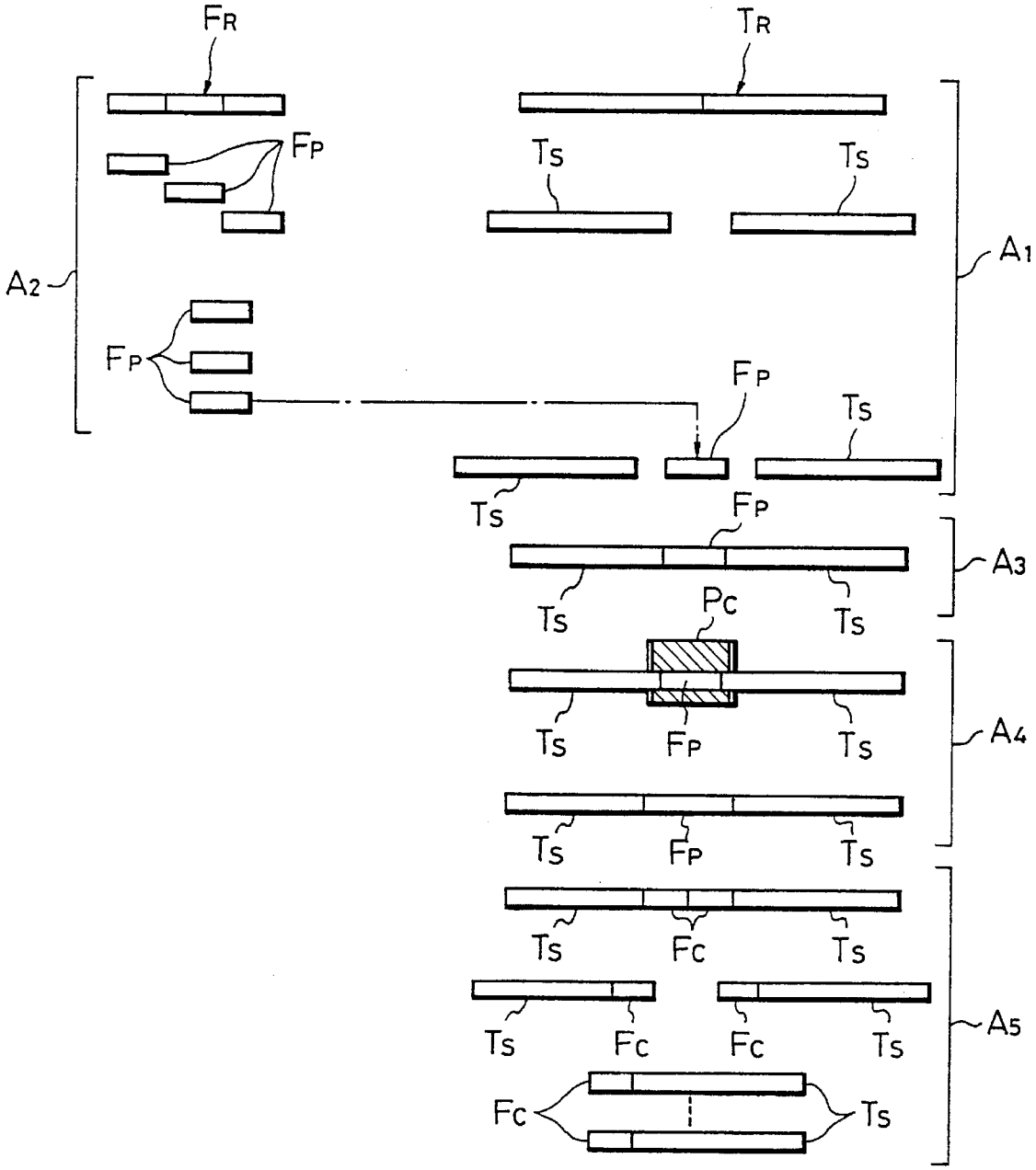
FIG. 2 is a schematic diagram illustrating a sequence of processes performed on cigarettes and filter rods in the filter attachment machine shown in FIG. 1.

While cigarette rods are transported toward the wrapping section 3 in this manner, each cigarette rod $T_R$ is cut into two equal parts, as indicated in part $A_1$ in FIG. 2, by a rotary knife 4 facing one of the intermediate drums, thus obtaining two cigarettes $T_S$. Further, the two cigarettes $T_S$ are set apart from each other to provide a predetermined space therebetween while they are transported toward the wrapping section 3.

Referring again to FIG. 1, a hopper 5 is arranged above the drum train 2 and contains a large number of filter rods. A drum train 6 similar to the drum train 2 extends between the hopper 5 and an intermediate drum of the drum train 2 located more downstream than the intermediate drum facing the rotary knife 4.

Filter rods $F_R$ are fed from the hopper 5 into the grooves of a drum located at the upstream end of the drum train 6, and as this drum rotates, each filter rod $F_R$ is cut into, for example, three equal parts, by two rotary knives 7 facing the drum, thus obtaining three filter plugs $F_P$ with a predetermined length, as shown in part $A_2$ of FIG. 2. The filter plug $F_P$ has a length twice that of a filter chip connected to each cigarette $T_S$. The three filter plugs $F_P$ are then arranged in line in the direction of transportation of filter plugs by an intermediate drum in the drum train 6 serving as a grading drum, and transported toward the drum at the downstream end of the drum train 6.

As shown at the bottom of part $A_1$ in FIG. 2, the filter plugs $F_P$ are fed one by one from the drum located at the downstream end of the drum train 6. Each filter plug $F_P$ is placed between two cigarettes $T_S$, which have already been received in the corresponding groove of the associated intermediate drum in the drum train 2 with space therebetween, such that the filter plug is in alignment with the two cigarettes. The filter plug $F_P$ is then transported, together with the corresponding two cigarettes $T_S$, toward the wrapping section 3 by the drum train 2. The two cigarettes $T_S$ are moved toward each other on the drum located at the downstream end of the drum train 2 such that they are in close contact with the opposite ends of the filter plug $F_P$, as shown in part $A_3$ of FIG. 2. Accordingly, when the wrapping section 3 is supplied with filter plugs $F_P$ and cigarettes $T_S$ from the drum train 2, each filter plug $F_P$ is interposed between the corresponding two cigarettes $T_S$.

The filter attachment machine is further provided with a paper feeder for supplying paste-applied pieces of tip paper to the wrapping section 3. In FIG. 1, the feeder extends from the upper left end of the base frame 1 to the wrapping section 3, and has a pair of rolls 8 and 8' on each of which continuous tip paper P is wound. The tip paper P has a width sufficiently greater than the length of the filter plug $F_P$.

The paper feeder includes a large number of guide rollers 9 defining a tip paper feed path extending from the rolls 8, 8' to the wrapping section 3 and a storage section 10 arranged halfway in the feed path, and the tip paper P unrolled from the roll 8 or 8' (in FIG. 1, roll 8') is guided toward the wrapping section 3 by the guide rollers 9. The storage section 10 temporarily stores the tip paper P, in order to absorb the difference between the speed of feeding tip paper pieces at the wrapping section 3 and the speed at which the tip paper P is unrolled from the roll 8 or 8'.

Further, the tip paper feeder has a connecting section 11 arranged on the upstream side of the storage section 10 for connecting ends of the tip paper P. To the connecting section 11, the leading end of the tip paper P from that roll (in FIG. 1, roll 8) which is not currently supplying tip paper is previously introduced. When the trailing end of the tip paper P from the other roll (in FIG. 1, roll 8') which is currently supplying tip paper reaches the connecting section 11, the supply of tip paper from the roll 8' is stopped, and the trailing end of tip paper P from the roll 8' is connected to the leading end of tip paper P from the other roll 8. While the tip paper connection is carried out in this manner, tip paper is fed from the storage section 10, thus permitting continuous supply of tip paper to the wrapping section 3.

The filter attachment machine further includes a paste applicator 12 arranged in the middle of the feed path for the tip paper P. The paste applicator 12 is composed of a paste supply roller 13 which rotates with part thereof immersed in paste in a paste container, not shown, and a paste transfer roller 14 which is disposed in rolling contact with the paste supply roller 13 and one side surface of the tip paper P. Thus, paste in the paste container adheres to the paste supply roller 13, then is transferred to the paste transfer roller 14 with the thickness thereof controlled to a predetermined thickness, and applied to the side surface of the tip paper P from the paste transfer roller 14. The paste applicator 12 used may be the one disclosed in Unexamined Japanese Patent Publication (KOKAI) No. 63-43077.

A preheater 15 and a postheater 16 are arranged on immediately upstream side and downstream side, respectively, of the paste applicator 12. As seen from FIG. 1, the preheater 15 heats the surface of the tip paper P to which paste is to be applied, whereas the postheater 16 heats the opposite surface, or the non-paste surface, of the tip paper P. Accordingly, the surface of the tip paper to which paste is to be applied can be effectively dried in advance. The postheater 16 will be explained in detail later.

At the downstream end of the feed path of the tip paper P, a cutter 18 is arranged for cutting the tip paper P, which has been applied with paste, into pieces with a predetermined length. The cutter 18 is composed mainly of a receiving drum 19 having an outer peripheral surface serving as a suction surface to which negative pressure is applied, and a bladed drum unit 20 arranged in the vicinity of the receiving drum 19. The drum 19 and the unit 20 are rotatable in opposite directions but at the same peripheral speed. Although not shown in FIG. 1, cutting blades are arranged on the outer peripheral surface of the bladed drum unit 20 at an equal distance from each other in the circumferential direction thereof.

Accordingly, when the tip paper P applied with paste reaches the receiving drum 19, the surface of the tip paper P opposite to the paste-applied surface is attracted by suction to the outer peripheral surface of the receiving drum 19. As the receiving drum 19 rotates, the tip paper P thus attracted to the outer peripheral surface of the receiving drum 19 is cut into pieces by the cutting blades of the bladed drum unit 20. Then, as the receiving drum 19 rotates, the cut pieces of tip paper are supplied toward the wrapping section 3 which adjoins both the receiving drum 19 and the drum located at the downstream end of the drum train 2.

Thereafter, as shown in part $A_4$ of FIG. 2, each piece $P_C$ of tip paper supplied to the wrapping section 3 is wrapped around and pasted to the filter plug $F_P$ and the two cigarettes $T_S$ associated therewith, which are simultaneously supplied from the drum train 2, in such a manner that the tip paper piece $P_C$ covers the entire surface of the filter plug $F_P$ and the inner end portions of the two cigarettes $T_S$ adjoining the filter plug $F_P$. In part $A_4$ of FIG. 2, the paste-applied surface of the tip paper piece $P_C$ is indicated by hatching.

In the wrapping section 3, the two cigarettes $T_S$ and the filter plug $F_P$ interposed therebetween, supplied from the drum train 2, are caused to roll between the wrapping section 3 and the receiving drum 19, and during-this rolling step, the tip paper piece $P_C$ is wound around the filter plug $F_P$ and the inner end portions of the cigarettes $T_S$. As a result, the two cigarettes and the filter plug are connected together, as shown in part $A_4$ of FIG. 2, thus obtaining a continuous, double-length filter cigarette.

Double-length filter cigarettes are then supplied to a drum located at the upstream end of a drum train 21, which is composed of a number of grooved drums and extends to the left in FIG. 1. In the process of transportation on the drums of the drum train 21, the double-length filter cigarettes are each cut in the center of the filter plug by a rotary knife 22 facing an intermediate drum of the drum train 21, thus obtaining individual filter cigarettes (see part $A_5$ of FIG. 2). Then, as shown in part $A_5$ of FIG. 2, the individual filter cigarettes are oriented in one direction, transferred to a conveyor, and then supplied to a subsequent packaging machine (not shown) by the conveyor. In FIG. 2, $F_C$ represents a filter chip obtained by cutting the filter plug $F_P$ into two.

A predrying apparatus according to one embodiment of the present invention, which is incorporated in the filter attachment machine, will be now described in detail.

The predrying apparatus serves to heat the tip paper to thereby preliminarily dry the paste applied to the tip paper by means of heat conducted to the paste from the tip paper, and the preliminary drying operation by this apparatus depends upon various conditions. Particularly it is to be noted that the predried state of paste varies greatly depending on the quantity of heat transferred to the tip paper from the predrying apparatus, and that this heat quantity varies greatly depending on the traveling speed of the tip paper.

In view of this, the predrying apparatus of this embodiment comprises detecting means for detecting the value of tip paper traveling speed, heating means for heating the surface of the tip paper opposite to the paste-applied surface, and heat control means for changing the degree or extent to which the tip paper is heated by the heating means, in accordance with the detected value of tip paper traveling speed, so that paste can always be predried properly by changing the degree of heating the tip paper by the heating means in accordance with the tip paper traveling speed.

Figure 3:
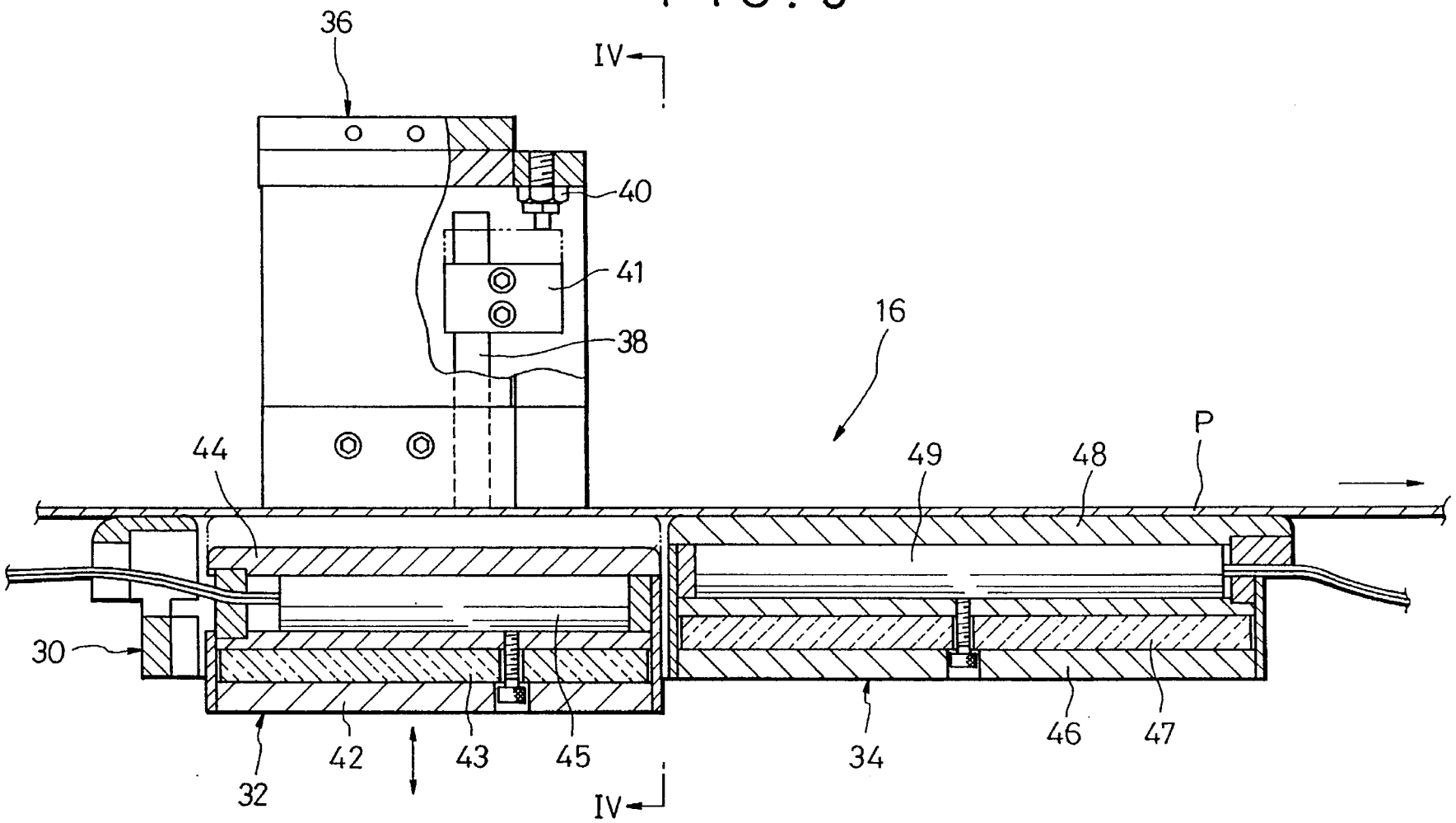
FIG. 3 is a vertical sectional view of a principal part of the predrying apparatus shown in FIG. 1.
Figure 4:
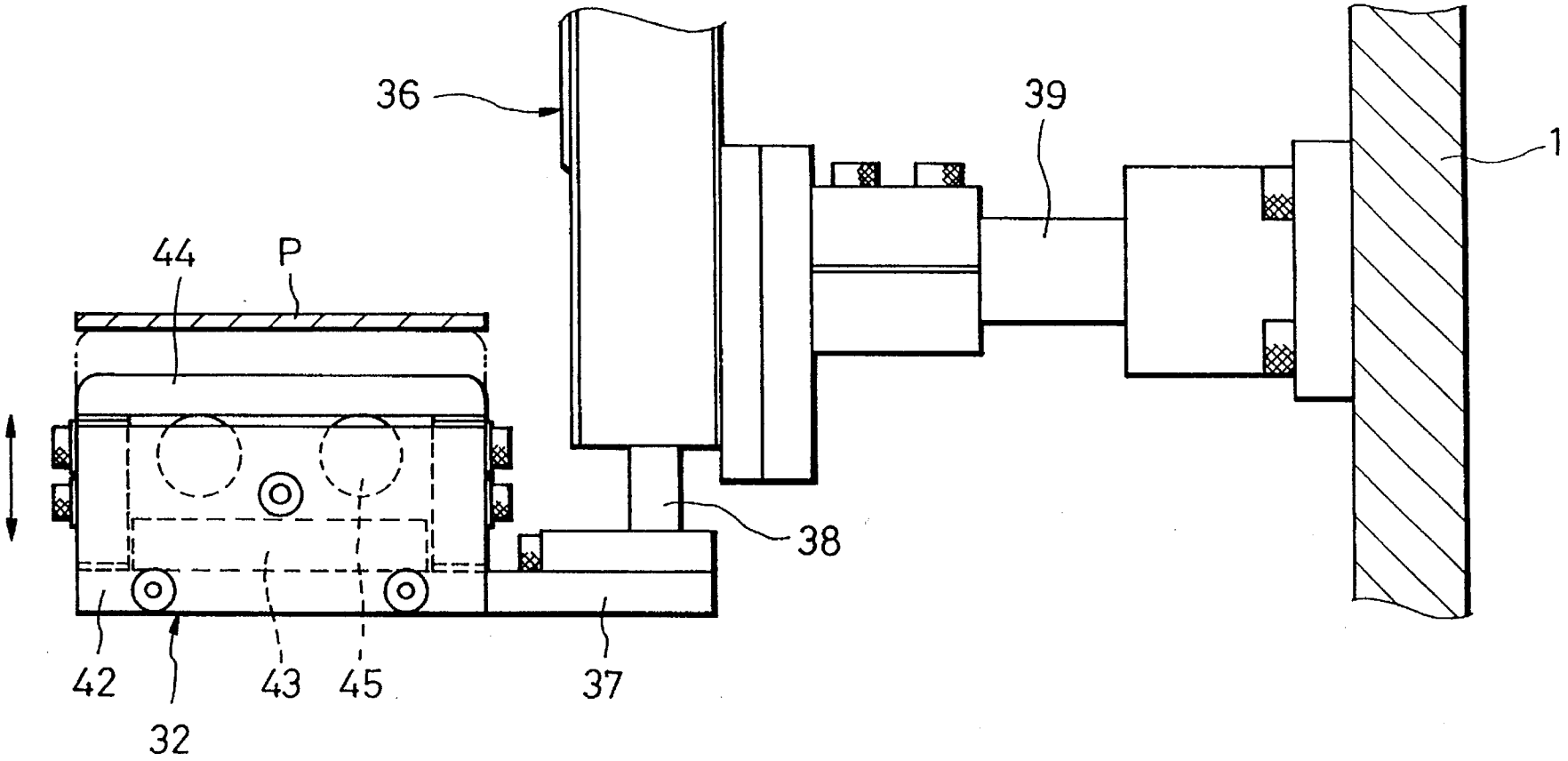
FIG. 4 is a sectional view of the principal part of the predrying apparatus, taken along line IV—IV in FIG. 3.

As shown in FIGS. 3 and 4, the postheater 16 as the heating means includes a fixed guide 30, a movable heater assembly (hereinafter referred to as "movable heater") 32, and a fixed heater assembly (hereinafter referred to as "fixed heater") 34, the elements 30, 32 and 34 being arranged in the order mentioned from the upstream side with respect to the traveling direction of the tip paper P.

The fixed guide 30 and the fixed heater 34 are mounted on the base frame 1 by supporting arms, not shown, and the upper surfaces of these elements 30 and 34 form a tip paper transport surface for guiding the tip paper P thereon while always maintaining the level of travel of the tip paper P at a fixed level. The transport surface contacts that surface of the tip paper P on which no paste is applied.

The movable heater 32 has a heater cartridge 44 mounted onto a heater frame 42 with a heat insulating member 43 therebetween, and two cylindrical heaters 45 are embedded in the heater cartridge 44-.I Similarly, the fixed heater 34 has a heater cartridge 48 mounted onto a heater frame 46 with a heat insulating member 47 therebetween, and two cylindrical heaters 49 are embedded in the heater cartridge 48. Thus, the movable heater 32 and the fixed heater 34 each emit heat from the upper surface thereof.

The movable heater 32 is driven by an actuator 36 associated therewith such that it is movable toward and away from the tip paper P which may be traveling or stopped at the travel level. Namely, the movable heater 32 is vertically movable between a remote position (second position) indicated by the solid line in FIG. 3 and a close position (first position) indicated by the two-dot-chain line in the same figure.

Figure 5:
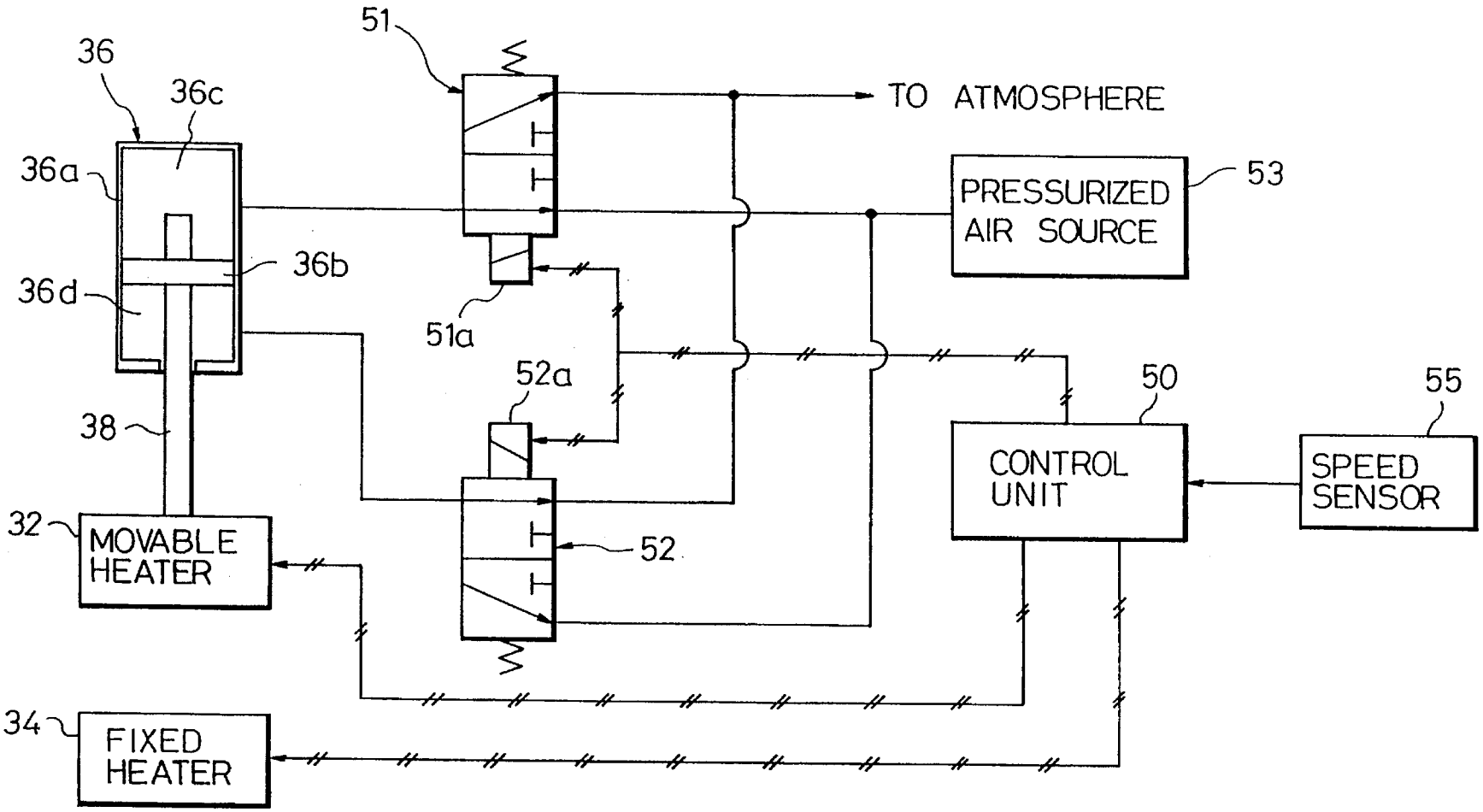
FIG. 5 is a block diagram illustrating an entire arrangement of the predrying apparatus of which the principal part is shown in FIGS. 3 and 4.

More specifically, the actuator 36 is mounted to a supporting arm 39 extending horizontally from the base frame 1. The actuator 36 comprises a double acting-type air cylinder, for example, and has a driving rod 38 extending downward from a cylinder body **36*a* (FIG. 5) thereof. The movable heater 32 is coupled to the lower end of the driving rod 38 via a supporting section 37. As shown in FIG. 5, the actuator 36 has a piston 36*b* securely fixed to the driving rod 38 and slidable within the cylinder body 36*a*, thus defining two, upper and lower cylinder chambers 36*c* and 36*d*. The cylinder chambers 36*c* and 36*d* are each selectively connected to a pressurized air source 53 or the atmosphere by means of a corresponding one of electromagnetic three-way valves 51 and 52 which are operated under the control of a control unit 50**.

The control unit 50 functions as the heat control means in cooperation with the actuator 36, and has an input side connected to a speed sensor 54 for detecting the traveling speed of the tip paper. The sensor 54 includes, for example, an encoder (not shown) for detecting the rotational speed of a delivery roller (not shown) for unrolling the tip paper from the roll 8, and an encoder (not shown) for detecting the rotational speed of a delivery roller (not shown) for unrolling the tip paper from the other roll 8', and each time the tip paper is unrolled from the roll 8 or 8' by a predetermined length, a pulse is output from the corresponding encoder to the control unit 50. The control unit 50 detects the value of tip paper traveling speed based on the intervals of the pulses output from the speed sensor 54, and determines whether the tip paper is stopped or traveling and whether the tip paper is traveling at low speed or high speed, based on the detected value of tip paper traveling speed and a set value indicating the upper limit of a low-speed range (the lower limit of a high-speed range).

When it is judged that the tip paper is stopped or traveling at low speed, the control unit 50 supplies a high-level control output to each of solenoids 51*a* and 52*a* of the respective electromagnetic valves 51 and 52 to energize the same, and when it is judged that the tip paper is traveling at high speed, the control unit 50 supplies a low-level control output to the solenoids 51*a* and 52*a* to deenergize the same. As a result, when the tip paper P is traveling at high speed, the movable heater 32 is set in the first position so as to be close to or in contact with the surface of the tip paper P opposite to the paste-applied surface; on the other hand, when the tip paper P is stopped or traveling at low speed, the movable heater 32 is set in the second position at a distance from the tip paper P, as described in detail later. The quantity of heat generated by each of the movable heater 32 and the fixed heater 34 is maintained at a fixed value, regardless of the traveling speed of the tip paper. Accordingly, the quantity of heat transferred to the tip paper P from the heaters 32 and 34 when the tip paper P is stopped or traveling at low speed is smaller than that transferred to the tip paper P during high-speed travel of the same. Namely, the degree or extent to which the tip paper P is heated by the movable heater 32 varies depending upon the traveling speed of the tip paper.

Further, the quantities of heat generated by the respective movable and fixed heaters 32 and 34 and the distance between the second position of the movable heater 32 and the travel level of the tip paper P are set to respective suitable values, such that the tip paper P is given a suitable quantity of heat from the heaters 32 and 34 not only when the tip paper P is traveling at high speed but also when the tip paper is stopped or traveling at low speed. In this embodiment, the heat quantity generated by the fixed heater 34 is set to a value smaller than that generated by the movable heater 32.

The actuator 36 further includes a spring shock absorber (speed reducing mechanism) 40 arranged therein and a stopper block 41 secured to the upper end portion of the driving rod 38. In the course of movement of the driving rod 38 toward the tip paper P, the spring force of the spring shock absorber 40 acts upon the driving rod 38 through the stopper block 41 after the stopper block 41 contacts the spring shock absorber 40 while the driving rod 38 keeps moving in the same direction, whereby the moving speed of the driving rod 38 is reduced.

The operation of the predrying apparatus for the filter cigarette manufacturing system will be now explained.

During operation of the filter cigarette manufacturing system, electric current is supplied to both the movable and fixed heaters 32 and 34 of the predrying apparatus under the control of the control unit 50, whereby heat is emitted from both heaters. Also, the value of tip paper traveling speed in the filter attachment machine is detected by the control unit 50 on the basis of the intervals of pulses supplied thereto from the speed sensor 54. Then, based on the detected value of tip paper traveling speed and the set value for discriminating the traveling speed range, the control unit 50 determines whether the tip paper P is stopped or is traveling at low speed or high speed.

When it is judged that the tip paper P is stopped or traveling at low speed, the control unit 50 supplies a high-level control output to the solenoids 51*a* and 52*a* of the respective electromagnetic valves 51 and 52, whereby the solenoids 51*a* and 52*a* are energized. As a result, the upper cylinder chamber 36*c* of the actuator 36 is connected to the pressurized air source 53 through the electromagnetic valve 51; therefore, pressurized air is supplied to the upper cylinder chamber 36*b*. In this case, the lower cylinder chamber 36*d* of the actuator 36 is connected to the atmosphere.

Consequently, a downward force acts upon the piston 36*b* of the actuator 36, whereby the movable heater 32, which is secured to the driving rod 38 integral with the piston 36*b*, lowers away from the tip paper P. When the movable heater 32 reaches the second position, a protuberance (not shown) formed on the driving rod 38 comes into contact with a stopper (not shown) of the cylinder body 36*a*, and thus the movable heater 32 is stopped at the second position.

When the movable heater 32 is in the second position where the distance between the heater 32 and the travel level of the tip paper P is large, the quantity of heat transferred to the tip paper P from the movable and fixed heaters 32 and 34 is suitable for the tip paper P which is stopped or traveling at low speed. Accordingly, the paste applied to the tip paper P can be properly predried. Consequently, the tip paper can be properly wrapped round the cigarettes and filter plugs in the wrapping section of the filter attachment machine, eliminating defective wrapping.

On the other hand, when it is judged that the tip paper P is traveling at high speed, the control unit 50 supplies a low-level control output to the solenoids 51*a* and 52*a* to deenergize the same. Accordingly, the upper cylinder chamber 36*c* is connected to the atmosphere through the electromagnetic valve 51, whereas the lower cylinder chamber 36*d* is connected to the pressurized air source 53 and thus is supplied with pressurized air. As a result, the movable heater 32 rises toward the tip paper P, together with the driving rod 38.

Before the movable heater 32 touches the tip paper P in the course of ascending motion of the movable heater 32, the stopper block 41 secured to the driving rod 38 comes into contact with the spring shock absorber 40 in the actuator 36. While the movable heater 32 further rises thereafter, the spring force of the spring shock absorber 40 acts upon the movable heater 32 through the stopper block 41, whereby the moving speed of the heater 32 is reduced. The movable heater 32 further moves toward the tip paper P against the spring force of the spring shock absorber 40, and when the heater 32 reaches the first position where it touches the tip paper P, the upper end of the driving rod 38 simultaneously comes into contact with the inner surface of the upper wall of the cylinder body 36*a*, whereby the movable heater 32 is stopped at the first position. Accordingly, the movable heater 32 is softly brought into contact with the tip paper P, and thus there is no possibility of the travel of the tip paper P being disturbed by sudden contact of the movable heater 32 with the tip paper P.

When the movable heater 32 is in the first position where the distance between the heater 32 and the travel level of the tip paper P is small, the quantity of heat transferred to the tip paper P from the movable and fixed heaters 32 and 34 is suitable for the tip paper P which is traveling at high speed. Accordingly, the paste applied to the tip paper P is properly predried, thus preventing defective wrapping of the tip paper at the wrapping section of the filter attachment machine.

While the tip paper P is predried by the movable heater 32, the travel level of the paper P is always kept at the same level by the transport surfaces of the fixed guide 30 and fixed heater 34, regardless of the position of the movable heater 32. Accordingly, in the type of filter cigarette manufacturing system wherein paste is applied to the tip paper P according to a predetermined pattern prior to the predrying step and then the tip paper P is cut according to the paste pattern after the predrying step to obtain tip paper pieces, there is no possibility of the cutting position for the tip paper being displaced from the paste pattern due to up-down motion of the movable heater 32. Thus, paste can be applied to a predetermined area of each piece of tip paper, and the tip paper pieces can be properly wrapped round the cigarettes and filter plugs.

The predrying apparatus of the present invention is not limited to the above embodiment, and various modifications are possible.

For example, in the above embodiment, the traveling speed of tip paper is used as a parameter that affects the heat quantity transferred to the predetermined surface of the tip paper from the heating means (more generally, parameter that affects the predried state of the paste), one or more other parameters relating to the predried state of paste may be used.

Further, although in the foregoing description the invention is applied to the predrying apparatus having the postheater 16 for heating the surface of tip paper opposite to the paste-applied surface, the present invention is applicable to a predrying apparatus having a preheater alone as the heating means for preliminarily heating the surface of tip paper to which paste is to be applied. In this case, the preheater 15 is designed to be movable toward and away from the tip paper in accordance with the tip paper speed or the like. Also, the present invention can be applied to a predrying apparatus having heating means other than the heater.

Figure 6:
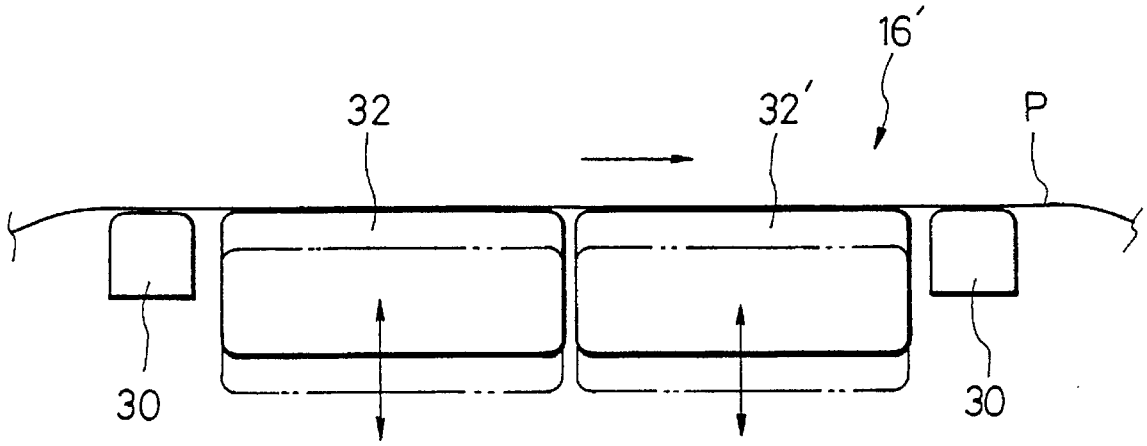
FIG. 6 is a schematic view showing a modification of the predrying apparatus.
Figure 7:
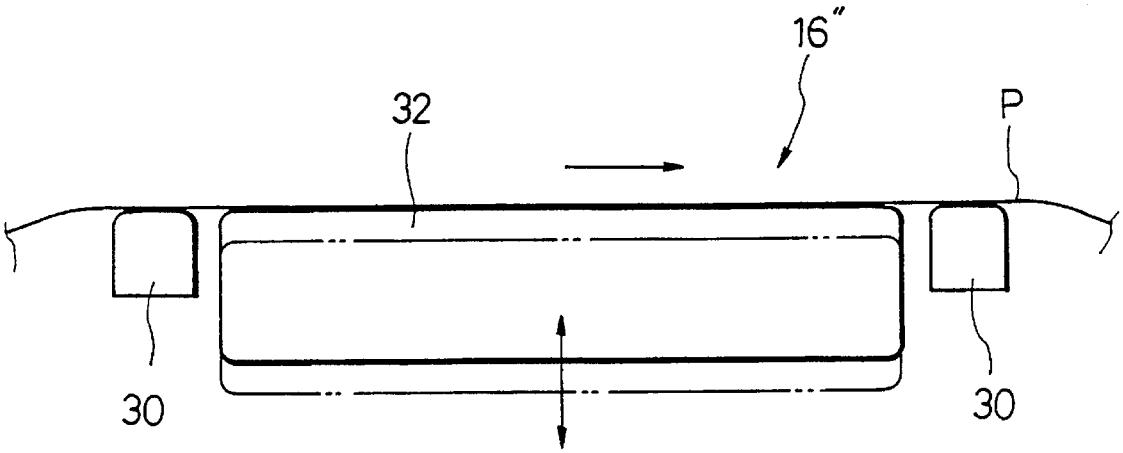
FIG. 7 is a schematic view showing another modification of the predrying apparatus.

Furthermore, in the above embodiment, the postheater 16 is used which is composed of the fixed heater 34 and the movable heater 32 arranged between the fixed guide 30 and the fixed heater 34 and movable toward and away from the tip paper P, but a postheater 16' shown in FIG. 6 or a postheater 16" shown in FIG. 7 may be used instead. The postheater 16' has two vertically movable heaters 32 and 32' arranged between a pair of fixed guides 30, whereas the postheater 16" has a single vertically movable heater 32 arranged between a pair of fixed guides 30.

In the embodiment, the movable heater 32 is shifted selectively to the first position (close position) or the second position (remote position); alternatively, the movable heater 32 may be designed to assume any desired position between the closest position and the remotest position in accordance with the tip paper traveling speed or the like. In this case, the movable heater is shifted to the remotest position when the tip paper is stopped, and is moved toward the closest position with increase in the traveling speed of the tip paper.

Further, although in the embodiment the actuator comprising a double acting-type air cylinder is used for moving the movable heater 32, an actuator comprising a single acting-type air cylinder combined with a spring or an electric actuator may be used.

Also, in the embodiment, the position of the movable heater 32 is changed to thereby change the degree to which the tip paper is heated by the movable heater, but the quantity of heat generated by the heater itself may be changed.

Furthermore, in the foregoing embodiment, the position of the movable heater 32 is automatically controlled by the control unit 50 through the actuator 36 in accordance with the traveling speed of the tip paper; alternatively, operator's manipulation may be involved in the movement control for the heater (more generally, control of the extent to which the tip paper is heated by the heating means). In the case of carrying out such manual control, for example, the output of the speed sensor 54 is displayed on a monitor, and the operator energizes or deenergizes the solenoids 51*a* and 52*a* of the electromagnetic valves 51 and 52 by turning on or off a manual switch (heat control means) in accordance with the tip paper traveling speed displayed on the monitor, to allow or stop the supply of pressurized air to the actuator 36.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A predrying apparatus for heating tip paper traveling along a tip paper transport path of a filter attachment machine of a filter cigarette manufacturing system to preliminarily dry paste applied to the tip paper, the apparatus comprising:

detecting means for detecting at least one first parameter value which affects predried state of the paste;

heating means for heating a predetermined surface of the tip paper; and heat control means for changing a degree to which the tip paper is heated by said heating means, in accordance with the detected value of said at least one first parameter, a rate at which the degree of heating the tip paper is promoted being reduced with an increase in the promoting rate during promotion of the heating degree.

2. The predrying apparatus according to claim 1, wherein said heat control means controls said heating means so as to reduce the degree of heating the tip paper by said heating means when the detected value of said at least one first parameter indicates that predrying is excessively performed, and controls said heating means so as to increase the degree of heating the tip paper by said heating means when the detected value of said at least one first parameter indicates that the predrying is excessively restricted.

3. The predrying apparatus according to claim 1, wherein said detecting means detects, as said at least one first parameter value, at least one second parameter value which affects a quantity of heat transferred to the predetermined surface of the tip paper from said heating means; and said heat control means controls said heating means so as to reduce the degree of heating the tip paper by said heating means when the detected value of said at least one second parameter indicates that the quantity of heat is excessively large, and controls said heating means so as to increase the degree of heating the tip paper by said heating means when the detected value of said at least one second parameter indicates that the quantity of heat is excessively small.

4. The predrying apparatus according to claim 3, wherein said detecting means detects, as said at least one second parameter value, a value of traveling speed of the tip paper; and said heat control means controls said heating means so as to reduce the degree of heating the tip paper by said heating means when the detected value of traveling speed of the tip paper indicates that the tip paper is stopped or traveling at low speed, and controls said heating means so as to increase the degree of heating the tip paper by said heating means when the detected value of traveling speed of the tip paper indicates that the tip paper is traveling at high speed.

5. The predrying apparatus according to claim 1, wherein said heating means includes a heater assembly movable toward and away from the predetermined surface of the tip paper for heating the predetermined surface of the tip paper;

said heat control means includes an actuator for moving the heater assembly toward and away from the predetermined surface of the tip paper; and said heat control means moves the heater assembly in a direction away from the predetermined surface of the tip paper by means of the actuator when the detected value of said at least one first parameter indicates that predrying is excessively performed, and moves the heater assembly in a direction toward the predetermined surface of the tip paper by means of the actuator when the detected value of said at least one first parameter indicates that the predrying is excessively restricted.

6. The predrying apparatus according to claim 5, wherein said detecting means detects, as said at least one first parameter value, at least one second parameter value which affects a quantity of heat transferred to the predetermined surface of the tip paper from said heater assembly; and said heat control means moves the heater assembly in a direction away from the predetermined surface of the tip paper by means of the actuator when the detected value of said at least one second parameter indicates that the quantity of heat is excessively large, and moves the heater assembly in a direction toward the predetermined surface of the tip paper by means of the actuator when the detected value of said at least one second parameter indicates that the quantity of heat is excessively small.

7. The predrying apparatus according to claim 6, wherein said detecting means detects, as said at least one second parameter value, a value of traveling speed of the tip paper; and said heat control means moves the heater assembly in a direction away from the predetermined surface of the tip paper by means of the actuator when the detected value of traveling speed of the tip paper indicates that the tip paper is stopped or traveling at low speed, and moves the heater assembly in a direction toward the predetermined surface of the tip paper by means of the actuator when the detected value of traveling speed of the tip paper indicates that the tip paper is traveling at high speed.

8. The predrying apparatus according to claim 7, wherein said heater assembly is movable between a first position where the heater assembly is in contact with or close to the predetermined surface of the tip paper, and a second position where the heater assembly is remote from the predetermined surface of the tip paper; and said heat control means positions the heater assembly at the second position by means of the actuator when the detected value of traveling speed of the tip paper indicates that the tip paper is stopped or traveling at low speed, and positions the heater assembly at the first position by means of the actuator when the detected value of traveling speed of the tip paper indicates that the tip paper is traveling at high speed.

9. The predrying apparatus according to claim 5, wherein said actuator includes a speed reducing mechanism for reducing moving speed of the heater assembly as the heater assembly approaches the predetermined surface of the tip paper.

10. The predrying apparatus according to claim 5, which further comprises:

a pair of fixed guides disposed in contact with the predetermined surface of the tip paper;

means for moving the tip paper along a tip paper transport path between the fixed guides; and said heater assembly is arranged along the tip paper transport path between said pair of fixed guides.

11. A filter attachment machine of a filter cigarette manufacturing system comprising the predrying apparatus according to claim 1, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

12. A filter attachment machine of a filter cigarette manufacturing system comprising the predrying apparatus according to claim 2, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

13. A filter attachment machine of a filter cigarette manufacturing system comprising the predrying apparatus according to claim 3, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

14. A filter attachment machine of a filter cigarette manufacturing system comprising the predrying apparatus according to claim 4, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

15. A filter attachment machine of a filter cigarette manufacturing system comprising the predrying apparatus according to claim 5, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

16. A filter attachment machine of a filter cigarette manufacturing system comprising the predrying apparatus according to claim 6, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

17. A filter attachment machine of a filter cigarette manufacturing system comprising the predrying apparatus according to claim 7, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

18. A filter attachment machine of a filter cigarette manufacturing system comprising the predrying apparatus according to claim 8, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

19. A filter attachment machine of a filter cigarette manufacturing system comprising the predrying apparatus according to claim 9, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

20. A filter attachment machine of a filter cigarette manufacturing system comprising the predrying apparatus according to claim 10, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

21. The predrying apparatus according to claim 5, further comprising means for moving the tip paper along a transport path, the transport path being fixed in the predrying apparatus and the heater assembly being movable toward and away from the transport path into and out of engagement with the tip paper.

22. The predrying apparatus according to claim 21, wherein the actuator includes a piston and cylinder for linearly reciprocating the heater assembly.

23. The predrying apparatus according to claim 1, further comprising means for moving the tip paper along a transport path, the transport path being fixed in the predrying apparatus and the heating means being movable toward and away from the transport path into and out of engagement with the tip paper.

24. The predrying apparatus according to claim 1, further comprising means for moving the tip paper along a transport path, and wherein the heating means comprises a movable heater and a fixed heater on opposing sides of the transport path of the tip paper, the tip paper being positionable between the movable heater and the fixed heater and wherein the predrying apparatus further comprises means for moving the movable heater toward and away from the tip paper on the transport path.

25. The predrying apparatus according to claim 10, wherein the heating assembly comprises at least one movable heater movable relative to the guides toward and away from the tip paper transport path.

26. A predrying apparatus for heating tip paper traveling along a tip paper transport path of a filter attachment machine of a filter cigarette manufacturing system to preliminarily dry paste applied to the tip paper, the apparatus comprising:

detecting means for detecting at least one first parameter value which affects predried state of the paste;

heating means for heating a predetermined surface of the tip paper, the heating means includes a heater assembly movable toward and away from the predetermined surface of the tip paper for heating the predetermined surface of the tip paper; and heat control means for changing a degree to which the tip paper is heated by said heating means, in accordance with the detected value of said at least one first parameter, the heat control means includes an actuator for moving the heater assembly toward and away from the predetermined surface of the tip paper, said heat control means moves the heater assembly in a direction away from the predetermined surface of the tip paper by means of the actuator when the detected value of said at least one first parameter indicates that predrying is excessively performed, and moves the heater assembly in a direction toward the predetermined surface of the tip paper by means of the actuator when the detected value of said at least one fist parameter indicates that the predrying is excessively restricted, the actuator of the heat control means includes a speed reducing mechanism for reducing moving speed of the heater assembly as the heater assembly approaches the predetermined surface of the tip paper.

27. A filter attachment machine of a filter cigarette manufacturing system comprising the predrying apparatus according to claim 26, comprising means for moving the tip paper along a transport path and a paste applicator, wherein said heating means is arranged on a downstream side of the paste applicator of the filter attachment machine with respect to the tip paper transport path, and the predrying apparatus heats the predetermined surface of the tip paper opposite to a surface thereof to which paste has been applied by the paste applicator.

28. A method for heating tip paper in predrying apparatus of a filter attachment machine of a filter cigarette manufacturing system to preliminarily dry paste applied to the tip paper, the method comprising the steps of:

moving the tip paper along a tip paper transport path, the transport path being fixed within the predrying apparatus;

detecting at least one first parameter value which affects predried state of the paste;

heating a predetermined surface of the tip paper with a heater assembly;

changing a degree to which the tip paper is heated in accordance with the detected value of said at least one first parameter, the step of changing comprising moving the heater assembly toward and away from the transport path into and out of engagement with the tip paper; and reducing the speed of the heater as the heater approaches the predetermined surface of the tip paper.

29. A method for heating tip paper in predrying apparatus of a filter attachment machine of a filter cigarette manufacturing system to preliminarily dry paste applied to the tip paper, the method comprising the steps of:

moving the tip paper along a tip paper transport path, the transport path being fixed within the predrying apparatus;

detecting at least one first parameter value which affects predried state of the paste;

heating a predetermined surface of the tip paper with a heater assembly;

changing a degree to which the tip paper is heated in accordance with the detected value of said at least one first parameter, the step of changing comprising moving the heater assembly toward and away from the transport path into and out of engagement with the tip paper; and simultaneously heating both sides of the tip paper moving along the tip paper transport path, the heater assembly including heaters on opposing sides of the transport path.

* * * * *